US008227398B2

(12) United States Patent
Kany et al.

(10) Patent No.: US 8,227,398 B2
(45) Date of Patent: Jul. 24, 2012

(54) CLEANING AND CORROSION INHIBITION SYSTEM AND COMPOSITION FOR SURFACES OF ALUMINUM OR COLORED METALS AND ALLOYS THEREOF UNDER ALKALINE CONDITIONS

(75) Inventors: Harry Kany, Hettenleidelheim (DE); Holger Theyssen, Freinsheim (DE)

(73) Assignee: Diversey, Inc., Sturtevant, WI (US)

( * ) Notice: Subject to any disclaimer, the term of this patent is extended or adjusted under 35 U.S.C. 154(b) by 0 days.

(21) Appl. No.: 13/298,919

(22) Filed: Nov. 17, 2011

(65) Prior Publication Data

US 2012/0065120 A1 Mar. 15, 2012

Related U.S. Application Data

(63) Continuation of application No. 10/593,365, filed as application No. PCT/US2005/004745 on Feb. 15, 2005, now Pat. No. 8,071,523.

(30) Foreign Application Priority Data

Mar. 23, 2004 (EP) ..... 04006942

(51) Int. Cl.
*C11D 7/36* (2006.01)
*C11D 1/34* (2006.01)

(52) U.S. Cl. ..... 510/254; 510/197; 510/202; 510/235; 510/236; 510/245; 510/255; 510/436

(58) Field of Classification Search ..... 510/197, 510/202, 235, 236, 245, 254, 255, 436
See application file for complete search history.

(56) References Cited

U.S. PATENT DOCUMENTS

| | | | | |
|---|---|---|---|---|
| 4,389,259 | A | 6/1983 | Danner et al. | |
| 4,528,039 | A | 7/1985 | Rubin et al. | |
| 4,578,208 | A | 3/1986 | Geke et al. | |
| 4,752,411 | A | 6/1988 | Melin et al. | |
| 4,775,427 | A | 10/1988 | Portz et al. | |
| 4,803,000 | A | 2/1989 | Uematsu et al. | |
| 4,983,317 | A | 1/1991 | Requejo et al. | |
| 5,180,579 | A * | 1/1993 | Birtwistle et al. | 424/70.19 |
| 5,200,114 | A | 4/1993 | Beck | |
| 5,259,960 | A | 11/1993 | Beck et al. | |
| 5,372,743 | A | 12/1994 | Miyamoto et al. | |
| 5,393,464 | A | 2/1995 | Martin et al. | |
| 5,723,418 | A | 3/1998 | Person Hei et al. | |
| 5,723,430 | A | 3/1998 | Mihelic | |
| 5,858,928 | A | 1/1999 | Aubert et al. | |
| 5,925,601 | A | 7/1999 | McSherry et al. | |
| 6,310,024 | B1 | 10/2001 | Gill et al. | |
| 6,566,408 | B1 * | 5/2003 | Cotrell et al. | 516/56 |
| 7,569,532 | B2 | 8/2009 | Man et al. | |
| 2003/0127111 | A1 | 7/2003 | Rouillard et al. | |

FOREIGN PATENT DOCUMENTS

| | | |
|---|---|---|
| JP | 59211581 | 11/1984 |
| JP | 60258299 | 12/1985 |
| JP | 11310883 | 11/1999 |
| JP | 2003268396 | 9/2003 |

* cited by examiner

*Primary Examiner* — Charles Boyer
(74) *Attorney, Agent, or Firm* — Gregory S. Bollis

(57) ABSTRACT

The present invention relates to corrosion inhibitor systems, in particular to cleaning and corrosion inhibiting compositions for surfaces of aluminum or colored metals and alloys thereof under alkaline conditions, especially in the food and pharmaceutical industries. The cleaning and corrosion inhibiting compositions comprise as a corrosion inhibitor at least one alkyleneoxy alkylphosphate di- or triester having the general formula (I)

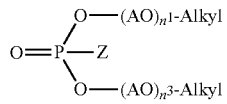

where Z is either —O-M or —O-(AO)$_{n^2}$-Alkyl
wherein M is an ammonium, alkali metal or alkaline earth metal cation, Alkyl is a $C_5$-$C_{22}$ alkyl or alkylaryl group, AO is a $C_{2-4}$-alkylene oxide unit and $n^1$, $n^2$ and $n^3$ each are integers from 2 to 10.

16 Claims, No Drawings

CLEANING AND CORROSION INHIBITION SYSTEM AND COMPOSITION FOR SURFACES OF ALUMINUM OR COLORED METALS AND ALLOYS THEREOF UNDER ALKALINE CONDITIONS

CROSS-REFERENCE TO RELATED APPLICATIONS

This application is a continuation of U.S. patent application Ser. No. 10/593,365, filed Jul. 12, 2007, now U.S. Pat. No. 8,071,523, Issued on Dec. 6, 2011, which is a U.S. National Phase 371 of International Application No. PCT/US2005/004745, filed on Feb. 15, 2005, which claims priority to EP 04006942.9, filed on Mar. 23, 2004, the contents of which are all incorporated herein by reference in their entirety.

FIELD OF THE INVENTION

The present invention relates to corrosion inhibitor systems, in particular to cleaning and corrosion inhibiting compositions for surfaces of aluminum or colored metals and alloys thereof under alkaline conditions, especially in the food and pharmaceutical industries. The cleaning and corrosion inhibiting compositions of the present invention can be used either in the form of concentrates or in the form of diluted use solutions or as an additive. Furthermore, the present invention relates to the use of such systems or compositions for treating surfaces of aluminum or colored metals and alloys thereof, preferably surfaces of copper, brass, bronze, zinc and bismuth, in order to clean and simultaneously protect them against corrosion, in particular in the food, dairy, beverage, brewery and soft drink industries as well as in the pharmaceutical industry.

BACKGROUND ART

Periodic cleaning and sanitizing in pharmaceutical, dairy, food and beverage industries, in food preparation and service businesses are a necessary practice for maintaining product quality and public health. Residuals left on equipment surfaces or contaminants found in the process or service environment are undesired since there is a risk that they promote growth of microorganisms. For protecting the consumer against potential health hazards associated with pathogens or toxins and maintaining the quality of the product or service in food and pharmaceutical industries it is necessary to routinely remove residuals and contaminants from surfaces of the equipment used in the pharmaceutical and food industries which usually is made of aluminum or colored metals like zinc, cadmium, copper, cobalt, nickel, bismuth, tin and lead or alloys thereof, in particular brass and bronze.

An efficient and economical way to remove undesired residuals and contaminants from hard surfaces of such metals and alloys thereof is the use of cleaner compositions which contain alkaline components besides wetting detergents. However, under alkaline conditions the protective oxide layer normally present on surfaces of aluminum and colored metals is removed and as a result thereof the bare metal surface will be heavily corroded. In many applications use of the most corrosion-resistant materials may be not economical or use of a material having a satisfactory corrosion resistance may not be known. Other methods of avoiding corrosion, such as by using glass, ceramic and inorganic coatings may be prohibitively expensive or incompatible with other process conditions. In all these cases an alternative approach is to minimize the corrosion by adding corrosion inhibitors to corrosive cleaning compositions. A further common way for preventing corrosion of colored metals in the pharmaceutical, food and beverage industries is the use of silicates having the disadvantage that unremovable residues may remain on the cleaned surfaces.

From U.S. Pat. No. 5,723,418 it is known to use lubricant compositions for conveyor systems which may transport food substances. The lubricant compositions disclosed therein may contain polycarboxylic acids such as carboxylic diacids, triacids or phosphate esters like alkyl or alkylaryl phosphate mono esters as corrosion inhibitors. According to U.S. Pat. No. 5,925,601 lubricants for conveyors moving glass, metal or plastic containers for the beverage market may contain phosphate esters like alkyl or alkylaryl phosphate mono esters or triazoles such as benzotriazole, tolyltriazole, and mercaptobenzothiazole as corrosion inhibitors. From U.S. Pat. No. 5,393,464 corrosion inhibitors in aqueous media are known which comprise N-ethoxy-2-substituted imidazoline, the N-ethoxy substituent having from 1 to 30 ethoxy units and the 2-substituent being an unsaturated fatty chain having from 6 to 30 carbon atoms.

SUMMARY OF THE INVENTION

However, all these known corrosion inhibitors do not sufficiently inhibit corrosion under alkaline conditions occurring in periodic cleaning and sanitizing of pharmaceutical and food equipments which are usually made of aluminum or colored metals and alloys thereof and which are normally heavily corroded under such conditions.

Therefore, the object of the present invention is to provide new corrosion inhibitors which reliably inhibit or reduce corrosion of surfaces of aluminum or colored metals and alloys thereof under alkaline cleaning conditions, especially of equipments used in the food and beverage industries as well as in the pharmaceutical industry.

Surprisingly, it has been found that specific alkoxylated alkyl and alkylaryl phosphate esters are excellent corrosion inhibitors for surfaces of aluminum or colored metals and alloys thereof which are commonly used for equipments in the pharmaceutical and food industries under alkaline cleaning conditions.

These specific alkoxylated alkyl and alkylaryl phosphate di- or triesters having the general formula (I) following below can be used as an active ingredient both in corrosion inhibitor systems for surfaces of aluminum or colored metals and alloys thereof in the presence of alkaline and optionally chelating agents, and in cleaning and corrosion inhibiting compositions for surfaces of aluminum or colored metals and alloys thereof in the form of concentrates or diluted use solutions as well as in processes for treating surfaces of aluminum or colored metals and alloys thereof, preferably of copper, brass, bronze, zinc and bismuth, wherein the metal surfaces are contacted with an effective amount of these specific alkoxylated alkyl and alkylaryl phosphate di- or triesters.

A subject-matter of the present invention is according to a first aspect a corrosion inhibitor system for surfaces of aluminum or colored metals and alloys thereof, the system comprising:

a) at least one alkyleneoxy-alkyl phosphate di- or triester having the general formula

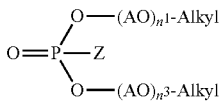

(I)

where Z is either —O-M or —O— $(AO)_{n^2}$-Alkyl wherein

M is an ammonium, alkali metal or alkaline earth metal cation,

Alkyl independent from each other, is a straight or branched, saturated or unsaturated alkyl group having from 5 to 22, preferably 8 to 18, more preferably 12 to 16 carbon atoms, or is an alkylaryl group wherein alkyl is as defined above and aryl is a monocyclic or bicyclic aromatic group, preferably a phenol, diphenol or any other hydroxy containing aryl radical, AO represents an alkylene oxide having from 2 to 4, preferably 2 to 3 carbon atoms which may be substituted by one or more $C_{1-3}$ alkyl groups, and $n^1$, $n^2$ and $n^3$ independent from each other are an integer of from 2 to 10, preferably 2 to 8, more preferably 3 to 6;

b) at least one alkaline agent in sufficient amount to achieve a pH of >7.0 in the global system, c) optionally at least one chelating agent, d) optionally at least one alkanolamine as an additional corrosion inhibiting agent and/or a further corrosion co-inhibitor, e) optionally at least one anionic, cationic, nonionic, and/or amphoteric surfactant and f) water.

Preferred embodiments of the present invention relate to corrosion inhibitor systems comprising, singly or in any combination(s), the following specific features, according to which:

in formula (I) of component (a) AO represents ethylene oxide (EO), propylene oxide (PO) and/or butylene oxide (BO), wherein EO, PO and BO can be present in any sequence order; AO especially representing ethylene oxide and/or propylene oxide;

the alkaline agent (component (b)) is selected from the group consisting of sodium or potassium hydroxide, sodium or potassium tripolyphosphate, ammonium, sodium or potassium carbonate and/or hydrogencarbonate and amines;

the chelating agent (component (c)) is selected from the group consisting of aminocarboxylic acids and salts thereof, phosphonic acids and salts thereof, gluconic acid and salts thereof and water-soluble acrylic polymers;

the chelating agent is more preferably selected from the group consisting of iminodisuccinic acid (IDS), nitrilotriacetic acid (NTA), ethylenediamine tetraacetic acid (EDTA), N-hydroxyethylethylenediamine triacetic acid (HEDTA), diethylenetriamine pentaacetic acid (DTPA), glutamic-N,N-diacetic acid (GLDA), aspartic-N,N-diacetic acid (ASDA), methylglycine diacetic acid (MGDA), hydroxyethyl iminodiacetic acid (HEIDA), triethylenetetramine hexaacetic acid (TTHA) and salts thereof;

the alkanolamine (component (d)) is diethanolamine or triethanolamine;

the tenside (component (e)) is a nonionic surfactant selected from the group consisting of ethoxylated alkylphenols, ethoxylated aliphatic alcohols, ethoxylated amines, ethoxylated etheramines, carboxylic esters, carboxylic amides, polyoxyalkyleneoxide block-copolymers and alkylated alkylethoxylates and/or an anionic surfactant selected from the group consisting of alkoxylated hydrocarbyl carboxylate, sulfonate, sulfate and phosphate esters, and/or a cationic surfactant selected from the group consisting of quaternary hydrocarbyl ammonium halides, and/or an amphoteric surfactant selected from betaine and sulfobetaine surfactants;

the corrosion inhibitor system further comprises at least one hydrotrope and/or at least one defoamer;

where the hydrotrope preferably is selected from the group consisting of monofunctional and polyfunctional alcohols and glycol and glycolether compounds, preferably alkyl alcohols, more preferably ethanol and isopropanol, and polyfunctional organic alcohols, preferably glycerol, hexylene glycol, polyethylene glycol, propylene glycol and sorbitol, especially alkyl glycols; and where the defoamer preferably is selected from the group consisting of silicone compounds, preferably silica dispersed in polydimethylsiloxane, fatty amides, hydrocarbon waxes, fatty acids, fatty esters, fatty alcohols, fatty acid soaps, ethoxylates, mineral oils, polyethylene glycolesters and polyoxyethylene-polyoxypropylene block copolymers.

According to another preferred embodiment the corrosion inhibitor system of the present invention additionally contains a corrosion co-inhibitor, selected from the group consisting of triazoles and derivatives thereof, preferably benzotriazole and tolyltriazole, imidazoline and derivatives thereof, preferably 1-aminoethyl-2-heptadecenyl imidazoline, and thiazole and derivatives thereof, preferably mercaptobenzothiazole.

The corrosion inhibitor system of the present invention as defined above preferably comprises:

a) from 0.01 to 15, preferably 0.1 to 10, more preferably 0.5 to 5 wt. % of the alkylenoxy-alkyl phosphate di- or triester of general formula (I), b) from 0.5 to 50, preferably 1 to 20, more preferably 3 to 8 wt. % of alkaline agent, the amount being sufficient to achieve a pH of >7.0 in the global system, c) optionally from 0.01 to 50, preferably 0.5 to 20, more preferably 1 to 6 wt. % of chelating agent, d) optionally from 0.05 to 10, preferably 0.1 to 5 wt. % of alkanolamine, e) optionally from 0.1 to 98, preferably 1 to 20, more preferably 3 to 8 wt. % of surfactant and f) water for the balance;

and according to a further preferred embodiment additionally comprises from 0.01 to 20, preferably 0.5 to 10 wt. % of hydrotrope and/or from 0.01 to 10, preferably 0.5 to 8, more preferably 0.1 to 5 wt % of defoaming agent.

A further subject-matter of the present invention is according to a second aspect a cleaning and corrosion inhibiting composition for surfaces of aluminum or colored metals and alloys thereof in the form of a concentrate or a diluted use solution, the composition comprising the components as defined above in amounts as disclosed above.

Subject-matter of the present invention is in particular a cleaning and corrosion inhibiting composition in the form of a concentrate comprising:

a) from 0.01 to 15, preferably 0.1 to 10, more preferably 0.5 to 5 wt. % of alkylenoxy-alkyl phosphate di- or triester of general formula (I), b) from 0.5 to 50, preferably 1 to 20, more preferably 3 to 8 wt. % of alkaline agent, the amount being sufficient to achieve a pH of >7.0 in the global system, c) optionally from 0.01 to 50, preferably 0.5 to 20, more preferably 1 to 6 wt. % of chelating agent, d) optionally from 0.05 to 10, preferably 0.1 to 5 wt. % of alkanolamine and/or a further corrosion co-inhibitor, e) optionally from 0.1 to 98, preferably 1 to 20, more preferably 3 to 8 wt. % of surfactant and f) water for the balance;

as well as a cleaning and corrosion inhibiting composition in the form of a diluted use solution comprising a) from 0.0001 to 0.15, preferably 0.001 to 0.10, more preferably 0.005 to 0.05 wt. % of alkylenoxy-alkyl phosphate di- or triester of general formula (I), b) from 0.005 to 0.50, preferably 0.01 to 0.20, more preferably 0.03 to 0.08 wt. % of alkaline agent, the amount being sufficient to achieve a pH of >7.0 in the global system, c) optionally from 0.0001 to 0.50, preferably 0.005 to 0.20, more preferably 0.01 to 0.06 wt % of chelating agent, d) optionally from 0.0005 to 0.10, preferably 0.001 to 0.05 wt. % of alkanolamine and/or a further corrosion co-inhibitor, e) optionally from 0.001 to 0.98, preferably 0.01 to 0.20, more preferably 0.03 to 0.08 wt. % of surfactant and f) water for the balance.

A further subject-matter of the present invention is according to a third aspect:

a process for treating surfaces of aluminum or colored metals and alloys thereof, preferably of copper, brass, bronze, zinc and bismuth, the process comprising subjecting the metal surfaces to the corrosion inhibitor system as defined above at a temperature of from 0 to 80° C., preferably 10 to 60° C., for 10 s to 60 min, preferably 20 s to 20 min; as well as a process for treating surfaces of aluminum or colored metals and alloys thereof, preferably of copper, brass, bronze, zinc and bismuth, the process comprising contacting the metal surfaces with an effective amount of a concentrate or a diluted use solution of the cleaning and corrosion inhibiting composition as defined above at a temperature of from 0 to 80° C., preferably 10 to 60° C., for 10 s to 60 min, preferably 20 s to 20 min.

Furthermore, the present invention relates to the use of the cleaning and corrosion inhibiting composition as defined above in the form of a concentrate or a diluted use solution or as an additive in an effective amount for treating surfaces of aluminum or colored metals and alloys thereof, preferably of copper, brass, bronze, zinc and bismuth.

DETAILED DESCRIPTION OF THE INVENTION

The subject-matters of the present invention are applicable especially in the following not limitative technical fields: daily cleaning processes in the pharmaceutical, food, beverage, dairy industries and kitchen hygiene. The corrosion inhibition system of the present invention in particular can be used in a process for cleaning hard surfaces in manual applications like foam and gel cleaning in the meat, fish, vegetable and fruit industries for example trolleys, metal dishes, metal plates and molds (open plant cleaning (OPC)), or for the exterior and interior cleaning of bottle and carton filling machines in the dairy, beverage and processed food industry (packing hall (PH)) or for the cleaning of process equipments like pipelines, mixers and storage tanks in the pharmaceutical, dairy, beverage and processed food industries (cleaning in place (CIP)).

As can be seen from the examples following below the corrosion resistance of surfaces of aluminum or colored metals and alloys thereof can be improved at least by factor 3 up to factor 1000 by using cleaning and corrosion inhibiting systems or compositions according to the present invention containing one or more alkyleneoxy-alkyl phosphate di- or triesters of general formula (I) as an active corrosion inhibiting component under alkaline cleaning conditions. This surprising and substantial technical effect is in particular remarkable in connection with surfaces of aluminum which are most sensitive against such cleaning conditions.

DEFINITIONS

The expression "corrosion inhibitor system" used in the present application means that components (b) to (f) of the system as defined above may be already present on the surfaces of aluminum or colored metals and alloys thereof, for example due to a preceding periodic cleaning and sanitizing treatment of such surfaces so that only component (a) has to be added in an effective amount to this system, optionally in combination with an alkaline and/or chelating agent, provided that the system being finally present at the location to be treated comprises at least components (a) and (f) of the claimed inhibitor system.

The expression "cleaning and corrosion inhibiting composition" as used in the present application means, on the other hand, that a completely formulated composition comprising components (a) to (f) as defined above in the form of a concentrate or in the form of a diluted use solution or as an additive is added to the location to be treated according to the present invention.

The expression "colored metal(s)" used in the present application comprises all heavy metals and alloys thereof which are colored or provide coloring effects with the exception of ferrous and nobel metals. The group of colored metals preferably comprises Zn, Cd, Cu, Co, Ni, Pb, Sn and Bi, and alloys thereof like brass and bronze. Particularly preferably colored metals and alloys thereof are zinc, copper, bismuth, brass and bronze.

The expression "water" used in the present application means any kind of water including fresh water and sea water, tap water of any origin, processed water, distilled water, deionized water, softened water, mineral water, rainwater and drinking water, preferably chemically pure water ($H_2O$).

The alkaline agents usable according to the present invention as component (b) include sodium hydroxide, potassium hydroxide and lithium hydroxide, preferably sodium hydroxide and potassium hydroxide. Furthermore, sodium and potassium tripolyphosphates, ammonium, sodium and potassium carbonates and/or hydrogencarbonates, amines and alkanolamines can be used as alkaline agents. Alkanolamines, in particular diethanolamine and triethanolamine, may also be used as additional corrosion inhibitors (component (d)).

The surfactants used according to the present invention (component (e)) are agents which are used as an adjuvant to increase detergency and wetting. Compounds which may be used as surfactants in the present invention include anionic, cationic, nonionic, zwitterionic and amphoteric surfactants.

Anionic surfactants which may be used according to the present invention are generally those compounds containing a hydrophobic hydrocarbon moiety and a negatively charged hydrophilic moiety. Typically, commercially available products provide either a carboxylate, sulfonate, sulfate or phosphate group as the negatively charged hydrophilic moiety. Particularly suitable anionic surfactants for use in the present invention are phosphate esters.

Nonionic surfactants are generally hydrophobic compounds which bear essentially no charge and exhibit a hydrophilic tendency due to the presence of oxygen in the molecule. Nonionic surfactants encompass a wide variety of polymeric compounds which include, but not exclusively, ethoxylated alkylphenols, ethoxylated aliphatic alcohols, ethoxylated amines, ethoxylated etheramines, carboxylic esters, carboxylic amides and polyoxyalkylene oxide block copolymers. Particularly suitable nonionic surfactants for use in the present invention are alkoxylated (preferably ethoxylated) alcohols.

Cationic surfactants are also useful in the present invention and may function also as an antimicrobial. Typical examples include quaternary ammonium chloride surfactants such as n-$C_{12-18}$ alkyl dimethyl benzyl ammonium chloride, e.g. n-tetradecyl dimethyl benzyl ammonium chloride monohydrate.

Zwitterionic and amphoteric surfactants which are useful in the present invention are surfactants containing both an acidic and a basic hydrophilic group. They can contain the anionic or cationic group common in anionic or cationic surfactants and additionally can contain either hydroxyl or other hydrophilic groups that enhance surfactant properties. Such amphoteric surfactants include betaine surfactants, sulfobetaine surfactant, amphoteric imidazolinium derivatives and others.

Chelating agents or sequestrants useful in the present invention are amino carboxylic acids, phosphonic acids and salts thereof and water-soluble acrylic polymers. Preferred amino carboxylic acid chelating agents include iminodisuccinic acid (IDS), nitrilotriacetic acid (NTA), ethylenediamine tetraacetic acid (EDTA), N-hydroxyethyl-ethylenediamine triacetic acid (HEDTA), diethylenetriamine pentaacetic acid (DTPA), glutamic-N,N-diacetic acid (GLDA), aspartic-N,N-diacetic acid (ASDA), methylglycine diacetic acid (MGDA), hydroxyethyl iminodiacetic acid (HEIDA), triethylenetetramine hexaacetic acid (TTHA) and salts thereof.

Useful chelating agents or sequestrants are also phosphonic acids and salts thereof. Preferred phosphonic acids include mono-, di-, tri- and tetra-phosphonic acids which may also contain groups capable of forming anions under alkaline conditions such as carboxy, hydroxy, thio and the like. The phosphonic acids may also comprise a low molecular weight phosphonopolycarboxylic acid such as one having about 2 to 4 carboxylic acid moieties and about 1 to 3 phosphonic acid groups. Such acids include 1-phosphono-1-methylsuccinic acid, phosphonosuccinic acid and 2-phosphonobutane-1,2,4-tricarboxylic acid and salts thereof.

The hydrotropes which may also be present in the corrosion inhibiting systems and compositions of the present invention impart physical stability to the systems and compositions, respectively. A variety of usable hydrotropes are available for use and include monofunctional and polyfunctional alcohols as well as glycol and glycol ether compounds.

The most useful hydrotrope compounds include alkyl alcohols such as ethanol, isopropanol and the like, polyfunctional organic alcohols like glycerol, hexylene glycol, polyethylene glycol, propylene glycol, sorbitol and the like. Further preferred hydrotropes are difunctional alcohols such as alkyl glycols. Other hydrotropes of interest include HLB surfactants such as toluene sulfonates, xylene sulfonates, cumene sulfonates, octyl sulfonates and the simpler ethoxylated phosphate esters.

The corrosion inhibition systems and compositions may also comprise a defoaming agent. A defoamer is a chemical compound with a hydrophobic-hydrophilic balance suitable for reducing the stability of protein foam. The hydrophobicity can be provided by an oleophilic portion of the molecule, for example an alkyl or aryl group, an oxypropylene unit or oxypropylene chain. The hydrophilicity can be provided by oxyethylene units, chains, blocks and/or ester groups.

Examples of defoaming agents suitable for use in the present invention include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycolesters, polyoxyethylene-polyoxypropylene block copolymers, alkyl phosphate esters and the like.

The corrosion inhibition systems and compositions of the present invention may also contain corrosion co-inhibitors in addition to component (a), i.e. compounds selected from the group consisting of triazoles and derivates thereof, preferably benzotriazole and tolyltriazole, imidazoline and derivatives thereof, preferably 1-aminoethyl-2-heptadecenyl imidazoline, and thiazole and derivatives thereof, preferably mercaptobenzothiazole, and mixtures thereof.

For a more complete understanding of the present invention reference is made to the following examples which, however, are to be construed only as illustrative and not limitative of the present invention.

EXAMPLES

In order to demonstrate that according to the present invention in fact a surprising and substantial technical effect in regard to inhibition or at least drastical reduction of corrosion of surfaces of aluminum or colored metals or alloys thereof over the relevant prior art can be achieved, the inventors of the present invention have carried out comparative tests wherein substrates of aluminum, copper, brass, zinc and bismuth in the form of coupons have been subjected to aqueous 1 wt. % use solutions of cleaning and corrosion inhibiting compositions of the present invention under defined experimental conditions in order to determine the anti-corrosion effects of various cleaning and corrosion inhibiting compositions.

In a first step cleaning and corrosion inhibiting concentrates (samples A to H) having the qualitative and quantitative compositions (in wt. %) given in the following Table 1 have been prepared by admixing the listed chemicals in sequential order, blending thoroughly by agitating and allowing each ingredient to completely disperse or dissolve in the liquid mixture before adding the next ingredient. The resulting composition concentrates were clear and homogeneously uniform upon admixture of all listed ingredients.

In a second step 1 wt. % use solutions of the concentrates given in Table 1 have been prepared by diluting them with a sufficient amount of deioized water.

In a third step the materials (substrates) to be tested in the form of coupons each having dimensions of 100 mm×50 mm×2 mm were cleaned with 400 ml of a 10 wt. % aqueous solution of sodium hydroxide for 30 s, rinsed with 100 ml of deionized water for 10 s, cleaned for 30 s in 400 ml of an aqueous 10 wt. % solution of nitric acid, rinsed for 20 s with 100 ml of deionized water, rinsed for 10 s with 50 ml of ethanol, dried overnight at room temperature (RT) and weighed, before they were soaked in 1000 ml of each of the stirred aqueous 1 wt. % use solutions having a temperature of 60° C. for a predetermined period of time (60 min/24 h) and then removed, rinsed with de-ionized water, dried overnight at room temperature as stated above and reweighed. The corrosion rates of the substrate coupons as an average value of each three measurements in mm per year were calculated from the following equation:

$$\text{corrosion rate (mm/year)} = \frac{W \times 8.76 \times 10^4}{D \times A \times T}$$

wherein:

W means the weight loss of each substrate coupon in g

D means the density of each substrate coupon in g/cm$^3$

A means the surface area of each substrate coupon in cm$^2$

T means the time of exposure in h.

The results obtained in each of the corrosion tests are given in Table 2 following below.

The corrosion tests were carried out with each 3 substrate coupons made of any of the following metals and alloys, respectively:

Aluminum

Aluminum coupons (purity 99.5 wt. %) with dimensions of 100 mm×50 mm×2 mm were cleaned for 30 s in 400 ml of an aqueous 10 wt. % solution of sodium hydroxide, rinsed for 20 s with 100 ml of deionized water, cleaned for 30 s in 400 ml of an aqueous 10 wt. % solution of nitric acid, rinsed for 20 s with 100 ml of deionized water, rinsed for 10 s with 50 ml of ethanol, dried overnight at room temperature and weighed.

The aluminum coupons were then placed in a 1500 ml beaker filled with 1000 ml of an aqueous 1 wt. % use solution of each of the concentrates A to H defined in Table 1 and thermostatically regulated to a temperature of 60° C. After 60 min the aluminum coupons were removed from the stirred beaker and then rinsed for 20 s with 100 ml of deionized water, dried overnight at room temperature and reweighed.

Copper

Copper coupons with dimensions of 100 mm×50 mm×2 mm were cleaned for 5 min in 400 ml of 100 wt. % concentrated acetic acid for removing fat and oxide from their surfaces, rinsed for 20 s with 100 ml of deionized water, rinsed for 10 s with 50 ml of ethanol, dried overnight at room temperature and weighed.

The copper coupons were then placed in a 1500 ml beaker filled with 1000 ml of a 1 wt. % use solution of each of the concentrates A to H defined in Table 1 having a temperature of 60° C. After 60 min the copper coupons were removed from the stirred beaker thermostatically regulated to a temperature of 60° C. and then rinsed for 20 s with 100 ml of deionized water, dried overnight at room temperature and reweighed.

Brass

Brass coupons with dimensions of 100 mm×50 mm×2 mm were cleaned for 5 min in 400 ml of 100 wt. % concentrated acetic acid for removing fat and oxide from their surfaces, rinsed for 10 s with 100 ml of deionized water, rinsed for 20 s with 100 ml of deionized water, rinsed for 10 s with 50 ml of ethanol, dried overnight at room temperature and weighed.

The brass coupons were then placed in a 1500 ml beaker filled with 1000 ml of a 1 wt. % use solution of each of the concentrates A to H defined in Table 1 having a temperature of 60° C. After 60 min the brass coupons were removed from the stirred beaker thermostatically regulated to a temperature of 60° C., then rinsed for 20 s with 100 ml of deionized water, dried overnight at room temperature and reweighed.

Zinc

Zinc coupons with dimensions of 100 mm×50 mm×2 mm were cleaned for 5 min in 400 ml of an aqueous 10 wt. % solution of acetic acid for removing fat and oxide from their surfaces, rinsed for 20 s with 100 ml of deionized water, rinsed for 10 s with 50 ml of ethanol, dried overnight at room temperature and weighed.

The zinc coupons were then placed in a 1500 ml beaker filled with 1000 ml of a 1 wt. % use solution of each of the concentrates A to H defined in Table 1 having a temperature of 60° C. After 60 min the zinc coupons were removed from the stirred beaker thermostatically regulated to a temperature of 60° C. and then rinsed for 20 s with 100 ml of deionized water, dried overnight at room temperature and reweighed.

Bismuth

For removing fat and oxide layer bismuth coupons (purity 99.5 wt. %) with dimensions of 70 mm×20 mm×8 mm were cleaned for 30 s with sandpaper, rinsed for 20 s with 100 ml of deionized water, rinsed for 10 s with 50 ml of ethanol, dried overnight at room temperature and weighed.

The bismuth coupons were then placed in a 1500 ml beaker filled with 1000 ml of a 1 wt. % use solution of each of the concentrates A to H defined in Table 1 having a temperature of 60° C. After 24 h the bismuth coupons were removed from the stirred beaker thermostatically regulated to a temperature of 60° C. and then rinsed for 20 s with 100 ml of deionized water, dried overnight at room temperature and reweighed.

As can be clearly seen from the results summarized in Table 2 under alkaline cleaning conditions only samples G and H according to the present invention were able to reduce corrosion of each of the substrate materials in a substantial extent, compared to sample A containing no corrosion inhibiting agent, compared to samples B to E each containing an alkoxy alkyl phosphate monoester (commercially available) as a corrosion inhibitor additive and compared to sample F containing another commercially available mixture of ethoxylated alkyl phosphate esters mainly consisting of phosphate mono-ester as a corrosion inhibitor additive.

According to the present invention the corrosion rates of copper, brass, zinc and bismuth substrates could be improved by factors 3 (copper), 5 (zinc) and 10 (brass and bismuth), while the improvement of the corrosion rate of an aluminum substrate was by factor from 370 to 1000, each compared to sample A.

TABLE 1

| | sample | | | | | | | |
|---|---|---|---|---|---|---|---|---|
| composition (wt. %) | A | B | C | D | E | F | G | H |
| softened water | 74.5 | 70.5 | 72.5 | 72.5 | 72.5 | 72.5 | 72.5 | 72.5 |
| soda ash ($Na_2CO_3$) | 3.5 | 3.5 | 3.5 | 3.5 | 3.5 | 3.5 | 3.5 | 3.5 |
| EDTA Na-salt (40% aqueous solution) | 12.5 | 12.5 | 12.5 | 12.5 | 12.5 | 12.5 | 12.5 | 12.5 |
| cumene sulfonic acid Na-salt (40% aqueous solution) | 5.5 | 5.5 | 5.5 | 5.5 | 5.5 | 5.5 | 5.5 | 5.5 |

TABLE 1-continued

| composition (wt. %) | sample A | B | C | D | E | F | G | H |
|---|---|---|---|---|---|---|---|---|
| ethoxylated (5 EO) $C_{13}$-alkanol (Lutensol T05) | 2.0 | 2.0 | 2.0 | 2.0 | 2.0 | 2.0 | 2.0 | 2.0 |
| Triethanolamine | 2.0 | 2.0 | 2.0 | 2.0 | 2.0 | 2.0 | 2.0 | 2.0 |
| alkoxylated alkylaryl phosphate monoester K-salt (50% aqueous solution) (Triton H66) | — | 4.0 | — | — | — | — | — | — |
| $C_6$-$C_{10}$-alkyl phosphate monoester (Korantin SMK) | — | — | 2.0 | — | — | — | — | — |
| alkyl phoshate K-salt (Berol 522) | — | — | | 2.0 | — | — | — | — |
| ethoxylated alkyl phosphate monoester K-salt (Berol 725) | — | — | | — | 2.0 | — | — | — |
| ethoxylated alkyl phosphate monoester Na-salt (Chimin F1) | — | — | | — | — | 2.0 | — | — |
| ethoxylated alkyl phosphate diester* (Phospholan PE65) | — | — | | — | — | — | 2.0 | — |
| ethoxylated alkyl phosphate diester* (Maphos P54) | — | — | | — | — | — | — | 2.0 |

*from two different suppliers

TABLE 2

| Composition (wt. %) | sample corrosion (mm/year) A | B | C | D | E | F | G | H |
|---|---|---|---|---|---|---|---|---|
| Aluminum (60° C./60 min) | 33.32 | 32.15 | 21.58 | 31.54 | 29.82 | 18.79 | 0.09 | 0.03 |
| Copper (60° C./60 min) | 0.35 | 0.21 | 0.39 | 0.25 | 0.20 | 0.26 | 0.10 | 0.07 |
| Brass (60° C./60 min) | 0.32 | 0.35 | 0.40 | 0.27 | 0.30 | 0.40 | 0.05 | 0.03 |
| Zinc (60° C./60 min) | 1.00 | 0.94 | 0.50 | 0.97 | 0.55 | 0.28 | 0.16 | 0.17 |
| Bismuth (60° C./24 h) | 0.023 | 0.014 | 0.022 | 0.011 | 0.042 | 0.008 | 0.003 | 0.002 |

The invention claimed is:

1. A corrosion inhibitor composition consisting of:

a) an alkyleneoxy-alkyl phosphate di- or triester having the general formula

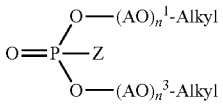

(I)

wherein Z is either —O-M or —O-$(AO)_n^2$-Alkyl, and further wherein

M is an ammonium, alkali metal or alkaline earth metal cation,

Alkyl independent from each other, is a straight or branched, saturated or unsaturated alkyl group having from 5 to 22 carbon atoms or is an alkylaryl group wherein alkyl is as defined above and aryl is a monocyclic or bicyclic aromatic group, AO represents an alkylene oxide having from 2 to 4 carbon atoms which may be substituted by one or more $C_{1-3}$ alkyl groups, and $n^1$, $n^2$ and $n^3$ independent from each other are an integer of from 2 to 10;

b) an alkaline agent in an amount sufficient to achieve a pH of >7.0 in the global composition;

c) a chelating agent;

d) an alkanolamine;

e) a nonionic surfactant;

f) water; and g) a hydrotrope.

2. The corrosion inhibitor composition of claim 1 wherein in formula (I) of component (a) AO represents ethylene oxide (EO), propylene oxide (PO) and/or butylene oxide (BO), wherein EO, PO and BO can be present in any sequence order.

3. The corrosion inhibitor composition of claim 1, wherein AO represents ethylene oxide and/or propylene oxide.

4. The corrosion inhibitor composition of claim 1, wherein the alkyleneoxy-alkyl phosphate di- or triester of formula I is an ethoxylated alkyl phosphate diester.

5. The corrosion inhibitor composition of claim 1, wherein the alkaline agent (component (b)) is selected from the group consisting of sodium and potassium hydroxides, sodium and potassium tripolyphosphates, ammonium, sodium and potassium carbonates and/or hydrogencarbonates and amines.

6. The corrosion inhibitor composition of claim 1, wherein the chelating agent (component (c)) is selected from the group consisting of aminocarboxylic acids and salts thereof, phosphonic acids and salts thereof, gluconic acid and salts thereof and water-soluble acrylic polymers.

7. The corrosion inhibitor composition of claim 1, wherein the chelating agent is selected from the group consisting of iminodisuccinic acid (IDS), nitrilotriacetic acid (NTA), ethylenediamine tetraacetic acid (EDTA), N-hydroxyethyl-ethylenediamine triacetic acid (HEDTA), diethylenetriamine pentaacetic acid (DTPA), glutamic-N,N-diacetic acid (GLDA), aspartic-N,N-diacetic acid (ASDA), methylglycine diacetic acid (MGDA), hydroxyethyl iminodiacetic acid (HEIDA), triethylenetetramine hexaacetic acid (TTHA) and salts thereof.

8. The corrosion inhibitor composition of claim 1, wherein the alkanolamine (component (d)) is diethanolamine or triethanolamine.

9. The corrosion inhibitor composition of claim 1, wherein the nonionic surfactant (component (e)) is selected from the group consisting of ethoxylated alkylphenols, ethoxylated aliphatic alcohols, ethoxylated amines, ethoxylated etheramines, carboxylic esters, carboxylic amides, polyoxyalkyleneoxide block-copolymers and alkylated alkylethoxylates.

10. The corrosion inhibitor composition of claim 1, wherein the hydrotrope is selected from the group consisting of monofunctional and polyfunctional alcohols, glycol and glycolether compounds, polyfunctional organic alcohols, toluene sulfonates, xylene sulfonates, cumene sulfonates, and octyl sulfonates.

11. The corrosion inhibitor composition of claim 1, wherein the corrosion inhibitor composition consists of:

a) from 0.01 to 15 wt. % of the alkylenoxy-alkyl phosphate di- or triester of general formula (I),
b) from 0.5 to 50 wt. % of the alkaline agent the amount being sufficient to achieve a pH of >7.0 in the global composition,
c) from 0.01 to 50 wt. % of the chelating agent,
d) from 0.05 to 10 wt. % of the alkanolamine,
e) from 0.1 to 98 wt. % of the nonionic surfactant,
f) water for the balance, and
g) from 0.01 to 20 wt. % of the hydrotrope.

12. The corrosion inhibitor composition of claim 1, wherein the corrosion inhibitor composition consists of:

a) from 0.5 to 5 wt. % of the alkylenoxy-alkyl phosphate di- or triester of general formula (I),
b) from 3 to 8 wt. % of the alkaline agent the amount being sufficient to achieve a pH of >7.0 in the global composition,
c) from 0.5 to 20 wt. % of the chelating agent,
d) from 0.1 to 5 wt. % of the alkanolamine,
e) from 1 to 20 wt. % of the nonionic surfactant,
f) water for the balance, and
g) from 0.5 to 10 wt. % of the hydrotrope.

13. The corrosion inhibitor composition of claim 1, wherein the corrosion inhibitor composition consists of:

a) from 0.0001 to 0.15 wt. % of the alkylenoxy-alkyl phosphate di- or triester of general formula (I),
b) from 0.005 to 0.50 wt. % of the alkaline agent, the amount being sufficient to achieve a pH of >7.0 in the global composition,
c) from 0.0001 to 0.50 wt. % of the chelating agent,
d) from 0.0005 to 0.10 wt. % of the alkanolamine,
e) from 0.001 to 0.98 wt. % of the nonionic surfactant,
f) water for the balance, and
g) from 0.0001 to 0.20 wt. % of the hydrotrope.

14. The corrosion inhibitor composition of claim 1, wherein the alkyleneoxy-alkyl phosphate di- or triester of formula I is characterized such that the corrosion inhibitor composition reduces the corrosion rate of a metal surface of aluminum or colored metals and alloys thereof subjected to the corrosion inhibitor composition at a temperature of from 0 to 80° C. for 10 s to 60 min as compared to the metal surface subjected to the corrosion inhibitor composition without the selected alkyleneoxy-alkyl phosphate di- or triester of formula I under the same conditions.

15. The corrosion inhibitor composition of claim 1, wherein the alkyleneoxy-alkyl phosphate di- or triester of formula I is characterized such that the corrosion inhibitor composition reduces the corrosion rate of an aluminum surface subjected to the corrosion inhibitor composition at a temperature of 60° C. for 60 min by a factor of at least 300 as compared to the aluminum surface subjected to the corrosion inhibitor composition without the selected alkyleneoxy-alkyl phosphate di- or triester of formula I under the same conditions.

16. The corrosion inhibitor composition of claim 1, wherein the alkyleneoxy-alkyl phosphate di- or triester of formula I is characterized such that the corrosion inhibitor composition reduces the corrosion rate of an aluminum surface subjected to the corrosion inhibitor composition at a temperature of 60° C. for 60 min by a factor of at least 1000 as compared to the aluminum surface subjected to the corrosion inhibitor composition without the selected alkyleneoxy-alkyl phosphate di- or triester of formula I under the same conditions.

* * * * *